US006667936B1

(12) United States Patent
Ditzig

(10) Patent No.: US 6,667,936 B1
(45) Date of Patent: Dec. 23, 2003

(54) BOTTLE CAP REMINDER DEVICE AND METHOD

(76) Inventor: Albert F. Ditzig, 1155 Mayfield La., Hoffman Estates, IL (US) 60195

( * ) Notice: Subject to any disclaimer, the term of this patent is extended or adjusted under 35 U.S.C. 154(b) by 0 days.

(21) Appl. No.: 10/281,001

(22) Filed: Oct. 25, 2002

(51) Int. Cl.[7] ..... G04B 47/00; G04F 10/00; G04C 3/00

(52) U.S. Cl. ..... 368/10; 368/107; 368/204

(58) Field of Search ..... 368/101, 107–113, 368/204

(56) References Cited

U.S. PATENT DOCUMENTS

| | | | | | |
|---|---|---|---|---|---|
| 4,251,604 | A | * | 2/1981 | Umemoto | 429/98 |
| 4,419,016 | A | * | 12/1983 | Zoltan | 368/10 |
| 4,551,028 | A | * | 11/1985 | Rowen et al. | 368/204 |
| 4,939,705 | A | * | 7/1990 | Hamilton et al. | 368/10 |
| 5,016,230 | A | * | 5/1991 | Seifers et al. | 368/10 |
| 5,058,086 | A | * | 10/1991 | Barlow | 368/98 |
| 5,253,228 | A | * | 10/1993 | Truett | 368/82 |
| 5,279,422 | A | | 1/1994 | Adams | |
| 5,313,439 | A | | 5/1994 | Albeck | |
| 5,358,117 | A | | 10/1994 | Adams | |
| 5,554,967 | A | * | 9/1996 | Cook et al. | 340/309.15 |
| 5,625,334 | A | | 4/1997 | Compton | |
| 5,720,392 | A | | 2/1998 | Price | |
| 5,751,661 | A | | 5/1998 | Walters | |
| 5,802,015 | A | * | 9/1998 | Rothschild et al. | 368/10 |
| 5,815,586 | A | | 9/1998 | Dobbins | |
| 5,846,089 | A | | 12/1998 | Weiss | |
| 5,953,288 | A | | 9/1999 | Chappell | |
| 6,084,504 | A | | 7/2000 | Rosche | |
| 6,194,995 | B1 | | 2/2001 | Gates | |
| 6,198,383 | B1 | | 3/2001 | Sekura | |
| 6,229,431 | B1 | | 5/2001 | Weiner | |
| 6,317,390 | B1 | | 11/2001 | Cardoza | |
| 6,324,123 | B1 | * | 11/2001 | Durso | 368/10 |
| 6,335,692 | B1 | | 1/2002 | Compton | |
| 6,335,907 | B1 | | 1/2002 | Momich | |
| 6,424,599 | B1 | * | 7/2002 | Ditzig | 368/10 |

* cited by examiner

*Primary Examiner*—David Martin
*Assistant Examiner*—Michael L. Lindinger
(74) *Attorney, Agent, or Firm*—Charles F. Meroni, Jr.; Meroni & Meroni, P.C.

(57) ABSTRACT

An adherent timer device for mounting upon a prescription medicine bottle cap. The device comprises a cover having an aperture through the cover and a skirt extending from the cover with a lip portion inwardly protruding from the skirt. An electronic counting means having an electronic display viewable through the aperture of the cover resides within the skirt. A battery powering the electronic counting means is springably engaged with the electronic counting means. A reset post for breaking engagement of the battery with the electronic counting means extends from the cover. An insulating pull tab is placed between the battery and a spring contact plate interrupting flow of energy from the battery to the electronic counting means. A mounting face has structure for snap fit engagement with the inner lip of the skirt and an adhesive backing for securing the mounting face to a prescription medicine bottle cap.

29 Claims, 3 Drawing Sheets

BOTTLE CAP REMINDER DEVICE AND METHOD

BACKGROUND OF THE INVENTION

1. Field of the Invention

The present invention generally relates to prescription medicine bottle timers. More specifically, the present invention relates to an improved bottle cap reminder device.

2. Description of the Prior Art

Using prescription drugs to treat ailments and illnesses is very common in modem medicine. In order to instruct patients of the need to regularly and consistently take prescription drugs, health care providers tell patients when to take prescribed dosages and pharmacists label the containers of prescription devices with the prescribed dosages and frequencies of taking the drugs.

Patients often forget to take their prescription drugs, hampering the effectiveness of the prescription drug upon the patient and potentially putting the patient's health in jeopardy. For this reason, a prescription reminder device that gives patients information concerning the frequency of attending to a prescription medicine bottle is important. Many reminder devices exist for reminding patients to take their prescription drugs. The following previously issued United States Patents disclose several of these devices.

U.S. Pat. No. 5,751,661 issued to Walters discloses a Medication Dosage Timing Apparatus. This invention comprises a container cap, a timer means for measuring elapsed time, and a display means for displaying the elapsed time. The display means is operatively coupled to the timer means. Further, a coupling means couples the timer means and the display means to the container cap. A battery carrier means is slidably coupled to the container cap for automatically moving a battery between a first position and a second position when the container cap is removed from the container. The timer means and the display means are thus responsive to movement of the battery carrier means as a result of removal and replacement of the container cap.

U.S Pat. No. 6,084,504 issued to Rosche et al. discloses an invention entitled: TIMING. This prior art reference teaches a method and apparatus that is attachable to a receptacle for timing a predetermined interval according to a timing schedule or a set of timing schedules. The apparatus has an electronic timing circuit that provides an alarm signal at the expiration of the predetermined time interval. The timing circuit includes a set of inputs and a set of outputs that are both connected to processing circuitry. The processing circuitry defines the set of selectable timing schedules. The inputs correspond to the timing schedules and the outputs issue the alarm signals. The apparatus also includes a sensing mechanism for selectively engaging an input based on the position of the mechanism. Each timing schedule is selectable by the device through the inputs that are engaged and disengaged.

U.S Pat. No. 6,229,431 issued to Weiner discloses a Medication Reminder Device. This invention discloses a device having a cap unit with a timer means for selecting a period between alarm signals and a central start and reset button with a light, the cap unite having internal electronics with a power supply to generate an alarm signal that is preferably visible, using the button light; audio, using a sound generating circuit; and physical, using a vibrator mechanism. The cap unit is connected to a compact container with a compartment or storage of pills, the compact container having an adapter cap for connecting the assembled device to a standard prescription container.

What is needed is a means for displaying the time elapsed since a prescription container or bottle has been opened, presumably, for taking a required dosage of prescription drugs, or medicine. The device must be simple in order to minimize the cost of manufacturing the device and capable of application to the varied standard prescription bottles and containers known in the art.

SUMMARY OF THE INVENTION

Accordingly, it is a principal object of the invention to provide a bottle cap reminder device that is compact and adaptable to any standard prescription bottle or container.

It is a further object of my invention to provide a bottle cap reminder device that displays the time elapsed since the bottle cap reminder device has been reset by a user of the device.

It is a further object of my invention to provide a bottle cap reminder device of simplified design resulting in reduced manufacturing costs for an effective bottle cap reminder device.

Other objects of my invention, as well as particular features, elements, and advantages thereof, will be elucidated in, or apparent from, the following description and the accompanying drawing figures.

The device generally comprises a lens, a top cover, a gasket, an electronic counting means, a power source, an insulating pull tab, a spring contact plate, a base, and a double sided adhesive strip.

The top cover is sized and shape to fit standard prescription medicine bottles and has a deflectable top face with an aperture for receiving the lens. The top face is surrounded by a skirt portion having an inwardly protruding lip and a reset post for actuating the reset button of the timer.

The gasket is sized and shaped to fit within the skirt portion of the top cover and adjacent the top face of the top cover. The gasket has an aperture slightly larger than the aperture through the top face for the lens and a second aperture slightly larger than the reset post for the reset post to extend through.

The electronic counter means is disposed within the top cover and has a time counter display that displays the elapsed time since the electronic counter means was last deactivated. The time counter display is positioned to be visible through the lens aperture of the top face. A power source provides the energy to run the electronic counter means.

The spring contact plate holds the battery that sits atop the spring contact plate against the electronic counting means completing the electronic counting means circuit.

The base of the device has a flat mounting face and an upwardly protruding skirt with an outwardly protruding lip to snap fit within the inwardly protruding lip of the top cover.

The double sided adhesive strip is shaped to be adhered to the mounting face of the base with one side of the adhesive strip being adhered to the mounting face of the base and a peel off backing fixed to the other side of the adhesive strip that can be removed when the device is to be mounted to the cap of a prescription medicine bottle.

BRIEF DESCRIPTION OF THE DRAWINGS

FIG. 1 shows a perspective view of the claimed invention adhered to a prescription medicine bottle cap that is fastened to a prescription medicine bottle.

FIG. 2 shows an exploded view of the device from the top side of the device.

FIG. 3 shows an exploded view of the device from the bottom side of the device.

FIG. 4 shows a cross sectional view of the device in the activated position.

FIG. 5 shows a cross sectional view of the device in the deactivated position.

DETAILED DESCRIPTION OF THE PREFERRED EMBODIMENT

Figure 1:
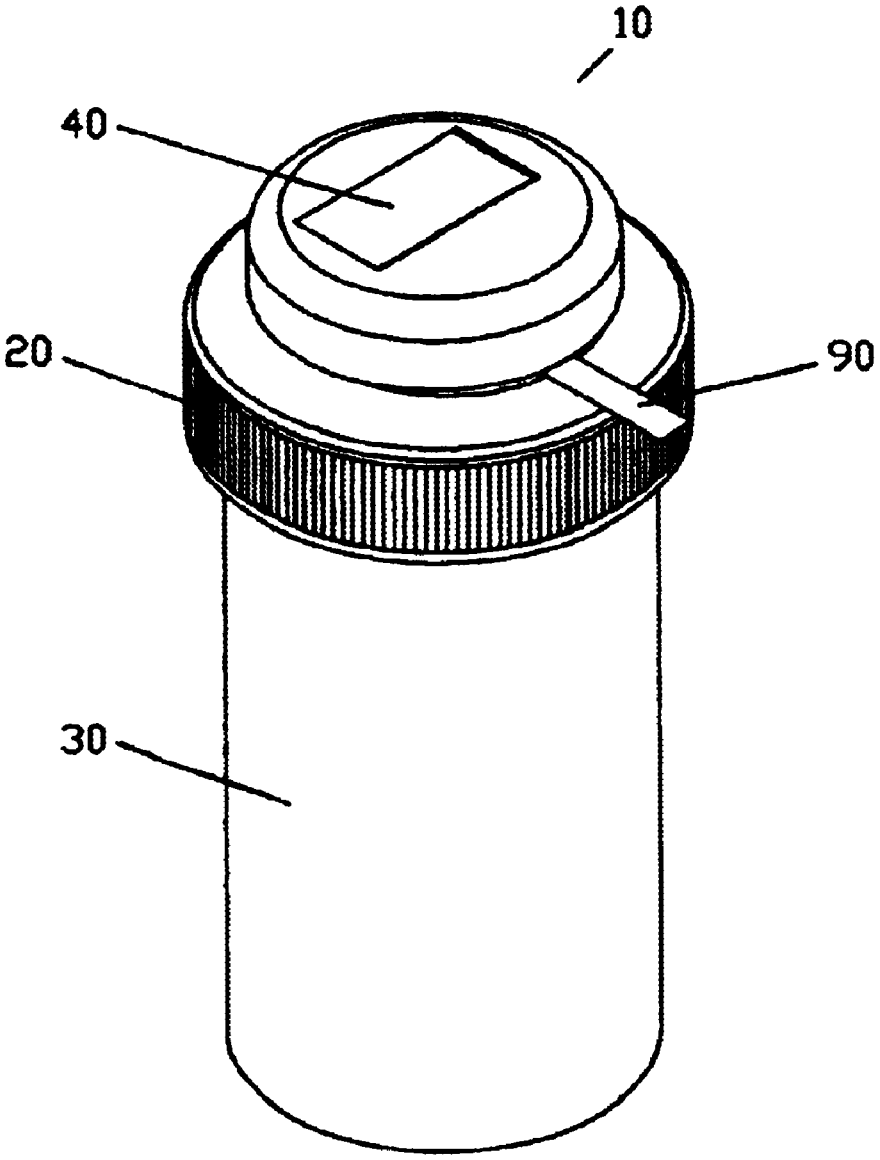
FIG. 1.

Turning now to the drawings, FIGS. 1–5 show a preferred embodiment of the improved timer device 10 for mounting upon a prescription medicine bottle cap 20 of a prescription medicine bottle 30. The device 10 generally comprises a lens 40, a top cover 50, a gasket 60, an electronic counting means 70, a power source 80, an insulating pull tab 90, a spring contact plate 100, a base 110, and a double sided adhesive strip 120.

Figure 2:
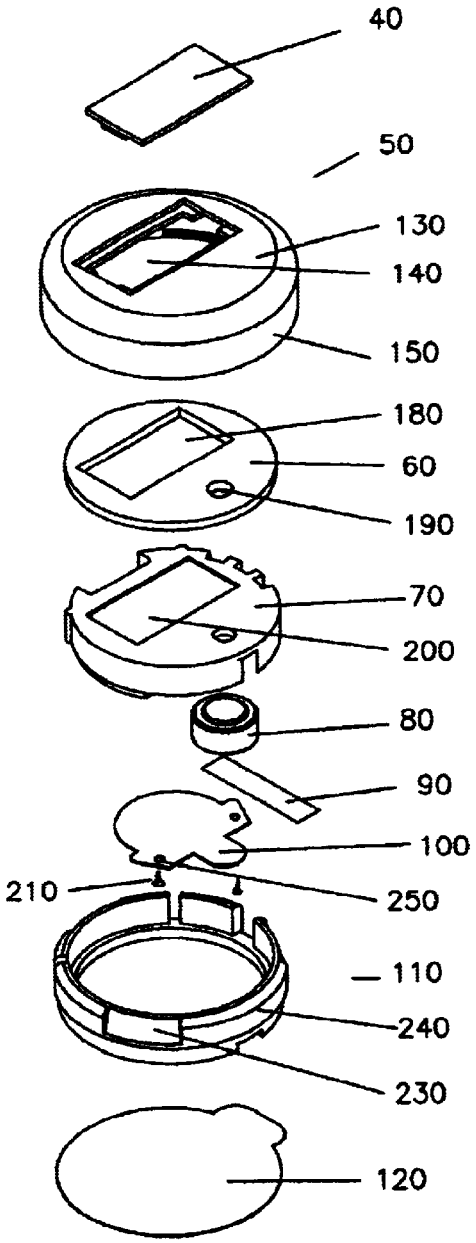
FIG. 2.
Figure 3:
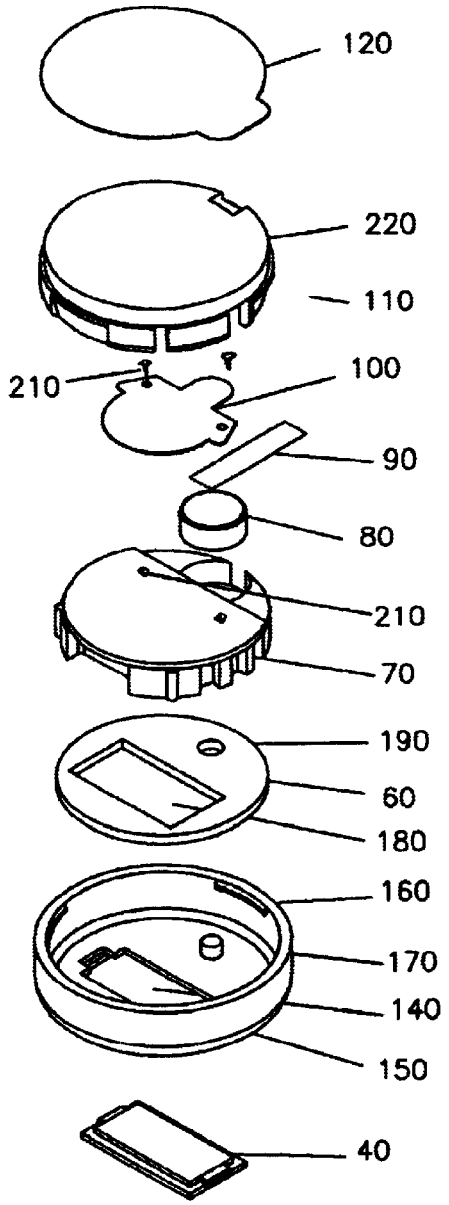
FIG. 3.

The top cover 50 shown in FIGS. 1–3 is preferably made of plastic and is round in shape to match the circular shape of standard prescription medicine bottles. The diameter of the top cover 50 is preferably 1.060 inches in diameter so that it is smaller than a typical prescription medicine bottle cap 20. However, the top cover 50 could be sized and shaped in a variety of different ways and still accomplish the objects of the claimed invention. The top cover 50 has a deflectable top face 130 with an aperture 140 for receiving the lens 40. The top face 130 is surrounded by a downwardly protruding skirt 150 portion having an inwardly protruding lip 160 and a reset post 170 for resetting the device 10.

The gasket 60 shown in FIG. 2–3 is preferably made of a soft open cell sponge like material and is sized and shaped to fit within the skirt portion 150 of the top cover 50 and adjacent the top face 130 of the top cover 50. The gasket 60 has an aperture 180 sized and shaped slightly larger than the aperture 140 through the top face 130 for the lens 40 and a second aperture 190 sized and shaped slightly larger than the reset post 170 for the reset post 170 to extend through.

The electronic counter means 70 shown in FIG. 2–3 is preferably a solid state circuit disposed within the top cover 50 and has a time counter display that displays the elapsed time since the electronic counter means 70 was last deactivated. The time counter display 200 is positioned coextensively with the aperture 140 in the top cover 50 in order to allow the time counter display 200 to be visible through the top cover 50. In the preferred embodiment of the invention, the time counter display 200 is a liquid crystal display and the electronic counter means 70 progressively counts time from 1 second to 23 hours 59 minutes and 59 seconds. If the electronic counting means 70 reaches 23 hours 59 minutes and 59 seconds, the time flashes and remains on 23 hours 59 minutes and 59 seconds until the electronic counter means 70 is reset.

A power source 80 provides the energy to run the electronic counter means 70. In the preferred embodiment, the power source 80 is a dry cell battery such as the one shown in FIG. 2–5. However, other forms of power such as solar cells may also be used. The power source 80 is preferably housed within the electronic counter means 70 and connected in circuit to the electronic counter means 70.

The spring contact plate 100 shown in FIG. 2–3 is preferably made of spring steel and is mounted to the base 110 by a pair of screws 210. The spring contact plate 100 holds the battery 80 that sits atop the spring contact plate 100 against the electronic counting means 70 completing the electronic counting means 70 circuit.

An insulating pull tab 90 placed between the spring contact plate 100 and the battery 80 breaks the electronic circuit interrupting the flow of energy from the battery 80 to the electronic counting means 70. Using an insulating pull tab 90 between the battery 80 and the spring contact plate 100 while the device 10 is not in use allows a simplified circuitry design, lowering the cost to manufacture a product based upon the claimed invention.

The base 110 of the device 10 shown in FIG. 2–3 is preferably made of plastic and has a circular mounting face 220. A skirt 230 extending from the mounting face 220 has an outwardly protruding lip 240 sized and shaped to snap fit with the inwardly protruding lip 160 of the top cover 50. The base 110 of the device 10 preferably has a pair of apertures 250 for the screws 210 that mount the spring contact plate 100 to the base 110 to extend through.

The double sided adhesive strip 120 shown in FIG. 2–3 is sized and shaped to be adhered to the mounting face 220 of the base 110. One side of the adhesive strip 120 is adhered to the mounting face 220 of the base 110 and a peel off backing 260 is fixed to the other side of the adhesive strip 120 that can be removed when the device 10 is to be mounted to the cap 20 of a prescription medicine bottle 30.

Figure 4:
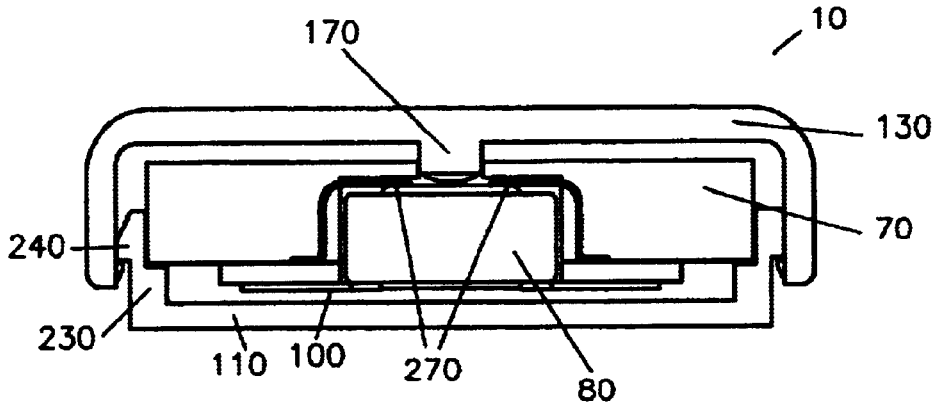
FIG. 4.

FIG. 4 shows a cross sectional view of the device 10 when the electronic counting means 70 is activated. The spring contact plate 100 holds the battery 80 against the electronic counting means 70 completing the circuit. The electronic counting means 70 counts the amount of time that has elapsed since the circuitry has been activated by the battery 80 being held against the electronic counting means 70.

Figure 5:
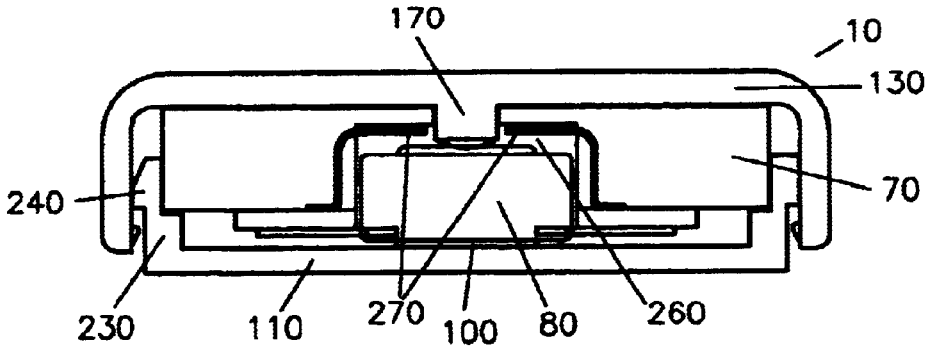
FIG. 5.

FIG. 5 shows a cross sectional view of the device 10 when the electronic counting means 70 is deactivated. The electronic counting means 70 is deactivated by a user of the device 10 pushing down on the deflectable top face 130 of the top cover 50, moving the reset post 170 against the top of the battery 80. The reset post 170 travels from about 0.020 inches to about 0.030 inches when the top face 130 is deflected by a user pressing upon the top face 130. When the reset post 170 pushes against the battery 80, the battery 80 deflects the spring contact plate 100 creating a gap 260 between the contact arms 270 and the battery 80, deactivating the electronic counting means 70. When the pressure being applied to the top face 130 of the top cover 50 is removed, the spring contact plate 100 pushes the battery 80 upward toward the contact arms 270 reactivating the electronic counting means 70.

This simplified way of activating and deactivating the device 10 reduces the complexity of the circuitry necessary to complete the device 10 and also reduces and simplifies the number of discrete part necessary to make the device 10. This simplification translates into a lower cost in manufacturing a product falling within the scope of the claimed invention. The simplification of the design also contributes to a timer having a streamlined profile. The preferred embodiment of the invention illustrated throughout the drawings has a side profile height of about 0.326 inches.

Although the invention has been described by reference to some embodiments it is not intended that the novel device be limited thereby, but that modifications thereof are intended to be included as falling within the broad scope and spirit of the foregoing disclosure, the following claims and the appended drawings.

I claim:

1. A timer device for disposition atop of a prescription container cap on a drug container comprising;

a. a timer device having an electronic timer circuit;

b. means for securing the timer device on the prescription container cap;

c. an electric battery for activating the electronic timer circuit;

d. the timer device having a housing with the electronic timer circuit and the battery stored therein;

e. a start timer insulated pull tab located between the electric battery electrode and the electrical timer circuit for maintaining the timer device in a deactivated condition;

f. the start timer insulated pull tab being releasably mounted and when the start timer insulated pull tab is pulled to expose the battery electrode, the battery then makes electrical contact with the timer electrical circuit to activate the electrical timer circuit.

2. The timer device of claim 1 wherein the pull tab when in a deactivated position extends radially outwardly beyond an outer perimeter of said device.

3. The timer device of claim 2 wherein the timer device has a timer means enabling the timer to be reactivated by pushing down on the electronic timer device toward a drug container to reactivate the timer during removal of the cap from the drug container.

4. A timer device for disposition atop of a prescription container cap on a drug container comprising:

a. a timer device having an electronic timer circuit;

b. means for securing the tinier device on the prescription container cap;

c. a battery for activating the electronic timer circuit;

d. the timer device having a housing with the electronic timer circuit and the battery stored therein;

e. a start timer insulated pull tab located between an electrical battery electrode and the electrical timer circuit for maintaining the timer device in a deactivated condition and with pull tab portion of the start timer insulated pull tab extending beyond the housing when the battery is in a deactivated state;

f. the start timer insulated pull tab being releasably mounted and when the pull tab portion is pulled moving the start timer insulated pull tab away to expose the battery electrode, the battery then making electrical contact with the timer electrical circuit to activate the electrical timer circuit; and g. the timer device having a bottom surface sized and shaped for mated engagement with a top surface of a prescription container cap, said means being attached to said bottom surface.

5. A timer device for disposition atop of a prescription container cap on a drug container comprising:

a. a timer device having an electronic timer circuit;

b. means for securing the timer device atop of the drug container;

c. an electric battery for activating the electronic timer circuit; the timer device having a housing with the electronic timer circuit and the battery stored therein;

d. a start timer insulated pull tab located between an electrical battery electrode and the electrical timer circuit for maintaining the timer device in a deactivated condition; the start timer insulated pull tab being releasably mounted and when the start timer insulated pull tab is pulled to expose the battery electrode, the battery then makes electrical contact with the timer electrical circuit to activate the electrical timer circuit;

e. the timer device having a bottom surface sized and shaped for mated engagement with a top surface of a prescription container cap, said means being attached to said bottom surface; and f. the means for securing the timer device comprising a double stick adhesive and a removable adhesive cover to expose the double stick adhesive to enable the double stick adhesive to connect the timer device to the cap on a drug container.

6. A timer device for disposition atop of a prescription container cap on a drug container comprising:

a. a timer device having an electronic timer circuit;

b. means for securing the timer device atop of the drug container;

c. a battery for activating the electronic timer circuit;

d. the timer device having a housing with the electronic timer circuit and the battery stored therein;

e. the timer device having a bottom surface sized and shaped for mated engagement with a top surface of a prescription container cap, said means being attached to said bottom surface;

f an insulated pull tab releasably mounted between the battery and the timer circuit maintaining the timer device in a deactivated condition, the pull tab activating the timer circuit when removed to expose the battery to the timer circuit.

7. The timer device of claim 6 said means for securing the timer device comprising a double stick adhesive and a removable adhesive cover to expose the double stick adhesive to enable the double stick adhesive to connect the timer device to a cap on a drug container.

8. An adherent timer device for mounting upon a prescription medicine bottle cap of a prescription medicine bottle, the device comprising:

a deflectable cover having a first side and a second side;

an aperture through the cover;

a skirt extending perpendicularly from the cover adjacent the second side of the cover;

a lip portion inwardly protruding from the skirt;

an electronic counting means having an electronic display residing within the skirt, the electronic display viewable through the aperture of the cover;

a battery for powering the electronic counting means having a first face adjacent the electronic counting means and a second face;

a spring contact plate engaged with the second face of the battery springably engaging the first face of the battery with the electronic counting means;

a reset post extending perpendicularly from the second side of the cover for breaking the engagement of the first face of the battery with the electronic counting means, the reset post contacting the first face of the battery deflecting the spring contact plate when the cover is deflected;

an insulating pull tab between the second face of the battery and the spring contact plate interrupting flow of energy from the battery to the electronic counting means, placement of the insulating pull tab between the battery and the electronic counting means preventing operation of the electronic counting means so that energy stored in the battery will not be depleted before use of the device;

a substantially flat mounting face sized and shaped to be affixed to a prescription medicine bottle cap parallel to the cover having structure for snap fit engagement with the inner lip of the skirt; and an adhesive backing attached to the mounting face for securing the mounting face to a prescription medicine bottle cap.

9. The device of claim 8 wherein the reset post is axially aligned with the battery.

10. The device of claim 9 wherein the insulating pull tab extends beyond the skirt providing a gripping surface for users of the device to remove the insulating pull tab from between the battery and the timing means.

11. The device of claim 10 further comprising a soft open cell sponge like material disposed between the cover and the timing means.

12. The device of claim 11 wherein the timing means progressively counts time from 1 second to 23 hours 59 minutes and 59 seconds.

13. The device of claim 12 wherein the electronic display is a liquid crystal display protected by a clear lens attached within the aperture of the cover.

14. An adherent timer device for mounting upon a prescription medicine bottle cap of a prescription medicine bottle in combination with a prescription medicine bottle cap, the combination comprising:

a prescription medicine bottle cap;

an adherent timer device, the device comprising:

a deflectable cover having a first side and a second side;

an aperture through the cover;

a skirt extending perpendicularly from the cover adjacent the second side of the cover;

a lip portion inwardly protruding from the skirt;

an electronic counting means having an electronic display residing within the skirt, the electronic display viewable through the aperture of the cover;

a battery for powering the electronic counting means having a first face adjacent the electronic counting means and a second face;

a spring contact plate engaged with the second face of the battery springably engaging the first face of the battery with the electronic counting means;

a reset post extending perpendicularly from the second side of the cover for breaking the engagement of the first face of the battery with the electronic counting means, the reset post contacting the first face of the battery deflecting the spring contact plate when the cover is deflected;

an insulating pull tab between the second face of the battery and the spring contact plate interrupting flow of energy from the battery to the electronic counting means, placement of the insulating pull tab between the battery and the electronic counting means preventing operation of the electronic counting means so that energy stored in the battery will not be depleted before use of the device;

a substantially flat mounting face sized and shaped to be affixed to a prescription medicine bottle cap parallel to the cover having structure for snap fit engagement with the inner lip of the skirt; and a double sided adhesive backing having a first face adhered to the mounting surface and a second face adhered to the prescription medicine bottle cap.

15. The combination of claim 14 wherein the reset post is axially aligned with the battery.

16. The device of claim 15 wherein the insulating pull tab extends beyond the skirt providing a gripping surface for users of the device to remove the insulating pull tab from between the battery and the timing means.

17. The device of claim 16 further comprising a soft open cell sponge like material disposed between the cover and the timing means.

18. The device of claim 17 wherein the timing means progressively counts time from 1 second to 23 hours 59 minutes and 59 seconds.

19. The device of claim 18 wherein the electronic display is a liquid crystal display protected by a clear lens attached within the aperture of the cover.

20. An adherent timer device for mounting upon a prescription medicine bottle cap of a prescription medicine bottle, the device comprising:

a deflectable cover;

an electronic counting means having an electronic display viewable through the cover;

at least two contact arms connected to the electronic counting means;

a power source having a first face adjacent the two contact arms and a second face opposite the first;

a spring contact plate engaged with the second face of the power source pushing the power source toward the two contact arms activating the electronic counting means;

a temporary insulating pull tab between the second face of the power source and the spring contact plate preventing activation of the electronic counter means prior to use of the electronic counting means;

a reset post extending from the cover between the two contact arms, the reset post contacting the first face of the power source deflecting the spring contact plate when the cover is deflected creating a gap between the two contact arms and the power source deactivating the electronic counting means;

a base connected to the top face;

an adhesive backing connected to the base for mounting to a prescription medicine bottle cap.

21. The device of claim 20 wherein the reset post deflects the spring contact plate from about 0.020 inches to about 0.030 inches.

22. The device in claim 21 wherein the temporary insulating pull tab extends beyond an outer edge of the cover.

23. The device of claim 22 further comprising a soft open cell sponge like material disposed between the cover and the electronic timing counting means.

24. The device of claim 23 wherein the electronic counting means progressively counts time from 1 second to 23 hours 59 minutes and 59 seconds.

25. The device of claim 24 wherein the electronic display is a liquid crystal display protected by a clear lens attached within the aperture of the cover.

26. The device of claim 25 wherein the reset post has a long axis that is axially aligned with a center point of the power source.

27. A timer device for disposition atop of a container cap of a drug container, the timer device comprising:

a housing sized for placement atop a container cap for drug containers;

an electronic timer circuit within the housing;

a battery within the housing for activating the electronic timer circuit;

means for securing the housing atop a container cap for drug containers; and an insulated pull tab releasably mounted between the battery and the timer circuit maintaining the timer device in a deactivated condition, the pull tab activating the timer circuit when removed to expose the battery to the timer circuit.

28. The timer device of claim 27 further comprising a reset means for resetting the timer circuit.

29. The timer device of claim 28 wherein the means for securing the housing atop a container cap for drug containers is adhesive.

* * * * *